United States Patent [19]

Danielsson

[11] Patent Number: 4,785,653

[45] Date of Patent: Nov. 22, 1988

[54] WIRE ROD BLOCK

[75] Inventor: Kurt Danielsson, Smedjebacken, Sweden

[73] Assignee: Centro-Morgardshammar AB, Smedjebacken, Sweden

[21] Appl. No.: 64,308

[22] PCT Filed: Oct. 7, 1986

[86] PCT No.: PCT/SE86/00456

§ 371 Date: May 28, 1987

§ 102(e) Date: May 28, 1987

[87] PCT Pub. No.: WO87/02280

PCT Pub. Date: Apr. 23, 1987

[30] Foreign Application Priority Data

Oct. 15, 1985 [SE] Sweden ..... 8504782

[51] Int. Cl.[4] ..... B21B 35/12; B21B 31/02; B21B 31/16

[52] U.S. Cl. ..... 72/249; 72/226; 72/237; 72/245

[58] Field of Search ..... 72/249, 243, 245, 237, 72/226, 248, 449

[56] References Cited

U.S. PATENT DOCUMENTS

| | | | |
|---|---|---|---|
| 2,094,920 | 10/1937 | Inslee | 72/249 X |
| 3,190,098 | 6/1965 | Wilson . | |
| 3,587,267 | 6/1971 | Townsend et al. . | |
| 3,611,531 | 10/1971 | Townsend et al. . | |
| 3,613,428 | 10/1971 | Townsend et al. . | |
| 3,750,448 | 8/1973 | Oxlade . | |
| 3,765,212 | 10/1973 | Moslener | 72/249 |
| 3,776,014 | 12/1973 | Artz et al. | 72/249 X |
| 3,818,742 | 6/1974 | Maltby et al. . | |
| 3,861,190 | 1/1975 | Maltby et al. . | |
| 3,946,587 | 3/1976 | Maltby . | |
| 3,964,282 | 6/1976 | Stubbs et al. . | |
| 4,018,073 | 4/1977 | Bartram et al. . | |

FOREIGN PATENT DOCUMENTS

| | | | |
|---|---|---|---|
| 0426062 | 3/1926 | Fed. Rep. of Germany . | |
| 2019142 | 6/1970 | France . | |
| 0980876 | 12/1982 | U.S.S.R. | 72/249 |
| 1002056 | 3/1983 | U.S.S.R. | 72/249 |
| 0722918 | 2/1955 | United Kingdom | 72/249 |

*Primary Examiner*—Robert L. Spruill
*Assistant Examiner*—Steven B. Katz
*Attorney, Agent, or Firm*—Young & Thompson

[57] ABSTRACT

A wire rolling machine comprising a pair of parallel drive shafts, a housing mounted for swinging movement on each drive shaft, and a first gear within the housing secured to each drive shaft. A second gear within the housing is driven by the first gear, a driven shaft within the housing bearing at one end the second end and emerging from the housing and bearing at an end opposite the second gear a driven roll. Each driven roll has a peripheral groove, the peripheral grooves being adapted to be brought into registry with each other when the housings are swung toward each other. The driven shafts swing in a common plane. Structure is provided to swing the housings relative to each other about the drive shafts.

1 Claim, 1 Drawing Sheet

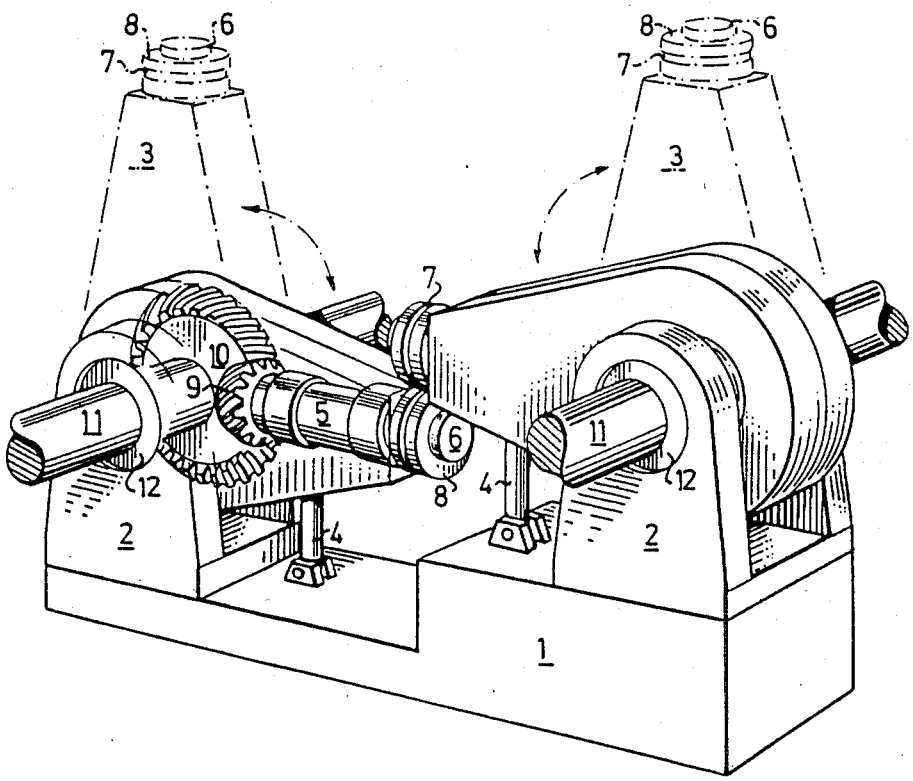
8
6
7
3
8
6
7
3
7
10
9
5
6
11
11
12
12
8
4
4
2
2
1

WIRE ROD BLOCK

FIELD OF THE INVENTION

The present invention relates to a wire rod block equipped with a pair of grooved rolls cooperating as rolling means.

BACKGROUND OF THE INVENTION

Presently wire having a diameter of 5.5 mm is rolled in blocks of this type at the comparatively high speed of 100 m/sec. The known blocks differ somewhat of course as to design, but they have the common feature that the rolling work is done between the two rolls provided with rolling grooves, said rolls being solidly fixed to a free end of an individual rotationally driven shaft, said free end extending from a housing common to both shafts. The reason for this is that the interior of the block can be maintained intact since all the required replacement of rolls can be done on the outside without any need to open the blocks, which could result in contamination because of the dirty rolling mill environment. Contamination of the interior of such a wire rod block could have catastrophic consequences since we are dealing with a high speed machine.

Developments in the rolling mill industry are however going towards higher and higher rolling speeds in order to achieve lower production costs. This especially applies to wire rolling. Multigroove wire rolling mills have been replaced by single groove mills with increased rolling speed.

In response to these developments, study of the possibilities of further increasing the final wire rolling speed within the scope of known technology has led to the realization that known wire blocks with the common basic features described above have too many rotating parts and bearings to permit a further increase in speed. It has also proved be the case that an optimum rolling process requires a relatively small roll diameter. This means in turn that the roll shaft diameter, i.e. the diameter of the shafts carrying the rolls is also reduced since the maximum conceivable roll shaft diameter is equal to the roll diameter minus the bearing thickness. Taken as a whole, these various circumstances will mean that a substantial increase in the roll speed of these known wire blocks with the common basic characteristics described here will result in such a great load on the bearings that the accompanying temperature rise therein will be unacceptable. The small roll shaft diameters will result in greater deflection of the shafts and thus very large deviations in wire dimensions.

In a known wire rod block with the above common basic features, and in which the two shafts extending from the common housing can be moved as a whole towards or away from each other while retaining a parallel relation to each other, there is the additional disadvantage that elevated rolling speeds will result in unacceptable vibrations as a result of the simultaneously increased rotational speed in the complicated transmission arrangement, which is required in this wire block to achieve the required parallel displaceability of the shafts.

Another problem caused by the parallel displaceability of the shafts is the seal arrangement between the block housing and the roll shafts radially displaceable in relation thereto. This sealing arrangement is already so complicated and expensive for the roll speeds now used that it could hardly be employed for still higher roll speeds in the future.

Our prior Swedish patent application No. 8502010-5 describes the advantages of being able to roll at lower temperatures. This increases the resistance to deformation and thus the roll pressure to such levels that the known wire blocks cannot withstand the loads. Therefore the purpose of the present invention is, starting from known wire rod blocks equipped with a pair of grooved rolls cooperating as rolling means, and solidly fixed to a freely projecting end of an individual rotationally driven shaft, to provide a new and improved block for wire rolling, which obviates the described problems and makes it possible to significantly increase rolling speeds.

SUMMARY OF THE INVENTION

Such a new and improved wire block according to the invention, which fulfils this purpose, is primarily characterized in that at least the free end of one shaft is movable towards and away from that of the other for setting the rolling gap between the rolls. By arranging the roll-bearing free ends of the shafts movable relative to each other, the roll shaft diameter in a wire block made according to the invention can be selected free from the limitations affecting the known wire blocks, so that their bearings can be optimized both with regard to loads and speed and without at the same time requiring complicated and expensive sealing means for the block housing, since the shafts do not move radially in relation to their housing.

In a particularly simple and easy-to-use embodiment of a wire block according to the invention, the two roll-carrying free shaft ends can be swung towards and away from each other in a single plane. This pivotability makes it possible to arrange the two free shaft ends, after the rolling gap has been set, to be directed essentially counter to each other. Operationally, a very simple and reliable gearing arrangement is sufficient for each roll shaft. Each roll shaft together with its associated simple gear box can suitably be mounted in a surrounding housing from which only the free shaft end extends, said housing being of simple shape and free of any complicated sealing arrangements, since only relatively easily sealed rotary bearings are used. In a particularly suitable embodiment in which the two shafts are each rotatably journalled in an individual housing containing a gearing arrangement, the output element being nonrotatably joined to the shaft journalled in the housing and the input element being nonrotatably joined to an input shaft to the housing, significantly design advantages are achieved if the two housings are arranged, for setting the rolling gap, pivotably about the axis of their respective input drive shafts.

In an embodiment of this wire block according to the invention particularly suited for practical use, the housings are arranged to be individually pivotable on a common frame in relation to which their pivot positions can be set by means of a force-absorbing setting means coupled between the housings and the frame. Wire blocks according to the invention can thus be arranged in horizontal and vertical sequences adapted to the groove series of the rolling mill. The input drive shafts can then either be coupled to each other or be arranged as a single long drive shaft, thus synchronizing the operation of all the blocks from a primary gear box in the conventional manner.

BRIEF DESCRIPTION OF THE DRAWING

The invention will be described below in more detail with reference to the accompanying drawing, which shows in a partially cutaway perspective view a particularly suitable embodiment of a wire rod block made according to the invention.

DETAILED DESCRIPTION OF THE INVENTION

As can be seen in the drawing, the embodiment shown here of a wire block according to the invention has a common frame 1, on top of which two bearing brackets 2 are mounted at different levels. A substantially pear-shaped housing 3 is pivotably mounted in each of these bearing brackets. The pivot positions for these housings relative to their bearing brackets and the frame supporting them can be set by means of setting means coupled between the housing 3 and the frame 1 in the form of hydraulic, mechanical turnbuckles or similar means with adjustable length.

The housings 2 are suitably cast in nodular iron and are made as two symmetrical halves, between which a driven shaft 5 is rotationally journalled with a smaller dimension shaft end 6 extending freely from each housing. A roll 8 with a roll groove 7 about its circumference is solidly fixed to each shaft end. The two rolls cooperate during the operation of the block. The free shaft ends 6, as a result of being mounted in the housings pivotable relative to the bearing brackets and the frame, are movable, in accordance with the invention, towards and away from each other for setting the size of the rolling gap between the rolls.

In the embodiment shown here, the two shaft ends 6 are pivotable towards and away from each other in a single plane. After setting the desired rolling gap between the grooved rolls 8, the two freely extending shaft ends 6 are at least essentially directed counter to each other. In other words, the roll shafts 5 in the embodiment shown here of a wire block according to the invention are directed essentially counter to each other when the block is in its operational state.

The roll 8 carrying shafts 5 rotationaly journalled in the housing 3 are driven by means of a gearing arrangement at the wider end of each housing. The output element, in the form of a pinion 9, is solidly fixed to the shaft 5 journalled in each housing 3. The input element 10 in the form of a bevel gear is nonrotatably joined to a drive shaft 11 entering each housing. All of the bearings are of hydrodynamic type, due to the very high running speeds and great bearing pressures.

The pivotability of the housings 3 for setting the rolling gap and for swinging out the housings for changing the rolls 8 is achieved by a projection 12 extending laterally from each housing half, journalled in a bearing bracket and surrounding the bearing for the drive shaft, whereby the housings are pivotable about the axis of the input shafts for setting the rolling gap. Between said projections 12 on the housing halves, which projections actually have the shape of short, thick journals, and the cooperating bracket lug there is suitably an inlaid plastic layer as a sliding bearing bushing.

The invention is not limited to the example described here and shown in the drawing but can be modified in various ways within the scope of the patent claims.

I claim:

1. A wire rolling machine comprising a pair of parallel drive shafts, a housing mounted for swinging movement on each drive shaft, a first gear within each housing secured to each drive shaft, a second gear within each housing driven by the first gear, a driven shaft within each housing bearing at one end a said second gear and emerging from said housing and bearing at an end opposite said second gear a driven roll, each driven roll having a peripheral groove, said peripheral grooves being adapted to be brought into registry with each other when said housings are swung toward each other, said driven shafts swinging in a common plane, and means to swing said housings relative to each other about said drive shafts.

* * * * *